US009869502B2

(12) United States Patent
Gardner et al.

(10) Patent No.: US 9,869,502 B2
(45) Date of Patent: Jan. 16, 2018

(54) METHOD FOR OPERATING A FAN OF A NUGGET ICE MAKER

(71) Applicant: General Electric Company, Schenectady, NY (US)

(72) Inventors: William Everette Gardner, Louisville, KY (US); Alan Joseph Mitchell, Louisville, KY (US)

(73) Assignee: Haier US Applicance Solutions, Inc., Wilmington, DE (US)

( * ) Notice: Subject to any disclaimer, the term of this patent is extended or adjusted under 35 U.S.C. 154(b) by 232 days.

(21) Appl. No.: 14/987,841

(22) Filed: Jan. 5, 2016

(65) Prior Publication Data

US 2017/0191723 A1 Jul. 6, 2017

(51) Int. Cl.

| | |
|---|---|
| ***F25C 1/14*** | (2006.01) |
| ***F25D 29/00*** | (2006.01) |
| ***F25D 17/06*** | (2006.01) |
| ***F25D 11/02*** | (2006.01) |
| ***F25D 23/02*** | (2006.01) |
| ***F25D 23/04*** | (2006.01) |
| ***F25C 5/18*** | (2006.01) |

(52) U.S. Cl.

CPC ..... *F25C 1/147* (2013.01); *F25C 5/182* (2013.01); *F25D 11/02* (2013.01); *F25D 17/065* (2013.01); *F25D 23/028* (2013.01); *F25D 23/04* (2013.01); *F25D 29/00* (2013.01); *F25C 2600/04* (2013.01); *F25C 2700/02* (2013.01); *F25C 2700/10* (2013.01); *F25D 2600/04* (2013.01); *F25D 2600/06* (2013.01); *F25D 2700/122* (2013.01)

(58) Field of Classification Search

CPC .. F25C 1/147; F25C 5/04; F25C 5/043; F25C 2600/04; F25C 2700/10

See application file for complete search history.

(56) References Cited

U.S. PATENT DOCUMENTS

| | | | | |
|---|---|---|---|---|
| 3,650,121 | A * | 3/1972 | Kimpel | F25C 1/147 62/136 |
| 3,769,809 | A | 11/1973 | Robinson et al. | |
| 5,191,772 | A * | 3/1993 | Engel | F25C 1/147 62/320 |
| 6,655,158 | B1 * | 12/2003 | Wiseman | F25C 5/187 62/353 |
| 7,788,934 | B2 * | 9/2010 | Kodama | F25C 1/147 62/135 |
| 2003/0010055 | A1 * | 1/2003 | Kuroyanagi | F25C 1/147 62/354 |
| 2003/0136136 | A1 * | 7/2003 | Nomura | F25C 1/147 62/136 |
| 2007/0125116 | A1 * | 6/2007 | Kuroyanagi | F25C 1/147 62/354 |
| 2010/0292846 | A1 * | 11/2010 | Lee | F25C 1/00 700/275 |
| 2010/0326093 | A1 * | 12/2010 | Watson | F25B 7/00 62/66 |

* cited by examiner

*Primary Examiner* — Jonathan Bradford
(74) *Attorney, Agent, or Firm* — Dority & Manning, P.A.

(57) ABSTRACT

A method for operating a fan of a nugget ice maker is provided. The method includes monitoring a speed of an auger of the nugget ice maker while a motor of the nugget ice maker rotates the auger and the fan of the nugget ice maker runs at a stored speed. A speed of the fan is increased when the speed of the auger stabilizes.

19 Claims, 7 Drawing Sheets

METHOD FOR OPERATING A FAN OF A NUGGET ICE MAKER

FIELD OF THE INVENTION

The present subject matter relates generally to nugget ice makers.

BACKGROUND OF THE INVENTION

Certain refrigerator appliances include an ice maker. To produce ice, liquid water is directed to the ice maker and frozen. A variety of ice types can be produced depending upon the particular ice maker used. For example, certain ice makers include a mold body for receiving liquid water. An auger within the mold body can rotate and scrape ice off an inner surface of the mold body to form ice nuggets. Such ice makers are generally referred to as nugget style ice makers. Certain consumers prefer nugget style ice makers and their associated ice nuggets.

Nuggets style ice makers generally include a motor coupled to the auger such that the motor rotates the auger within the mold body during operation of the motor. Rotating the auger with a motor can pose challenges. For example, operating the motor at a single power is simple and generally preferable. However, a torque on the motor can vary, and consistent high torques can negatively affect motor life. To avoid extraneous torque on the motor, certain refrigerator appliances stop cooling the mold body to reduce an ice formation rate on the mold body and reduce torque on the motor. However, interrupting cooling reduces an ice formation rate of the ice maker.

Accordingly, a method for operating an ice maker that assists with limiting torque on a motor of the ice maker would be useful. In particular, a method for operating a nugget style ice maker that assists with limiting torque on an auger motor of the nugget style ice maker would be useful.

BRIEF DESCRIPTION OF THE INVENTION

The present subject matter provides a method for operating a fan of a nugget ice maker. The method includes monitoring a speed of an auger of the nugget ice maker while a motor of the nugget ice maker rotates the auger and the fan of the nugget ice maker runs at a stored speed. A speed of the fan is increased when the speed of the auger stabilizes. Additional aspects and advantages of the invention will be set forth in part in the following description, or may be apparent from the description, or may be learned through practice of the invention.

In a first exemplary embodiment, a method for operating a fan of a nugget ice maker is provided. The method includes running the fan at a stored speed, activating a motor of the nugget ice maker such that the motor of the nugget ice maker rotates an auger of the nugget ice maker, monitoring a speed of the auger while the motor of the nugget ice maker rotates the auger of the nugget ice maker and the fan runs at the stored speed, and increasing a speed of the fan when the speed of the auger stabilizes during the step of monitoring.

In a second exemplary embodiment, a method for operating a fan of a nugget ice maker is provided. The method includes operating the fan at a first speed, activating a motor of the nugget ice maker such that the motor of the nugget ice maker rotates an auger of the nugget ice maker, monitoring a speed of the auger while the motor of the nugget ice maker rotates the auger of the nugget ice maker, and operating the fan at a second speed when the speed of the auger is substantially constant for a predetermined period of time during the step of monitoring, the second speed being greater than the first speed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
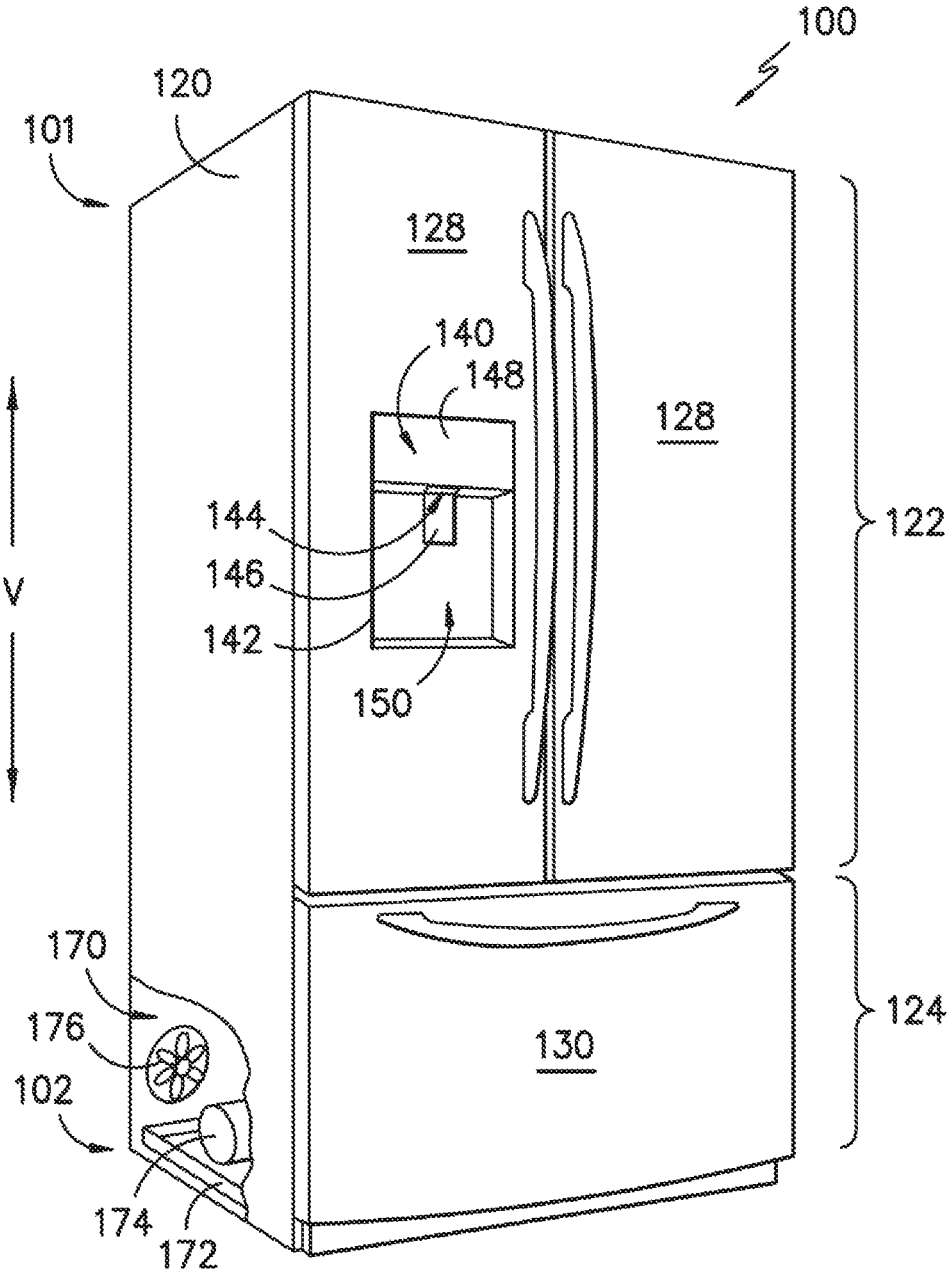
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top portion 101 and a bottom portion 102 along a vertical direction V. Housing 120 defines chilled chambers for receipt of food items for storage. In particular, housing 120 defines fresh food chamber 122 positioned at or adjacent top portion 101 of housing 120 and a freezer chamber 124 arranged at or adjacent bottom portion 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance, and to standalone ice makers. Consequently, the description set forth herein is for illustrative purposes only and is not intended to be limiting in any aspect to any particular type of appliance or refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 120. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

Figure 2:
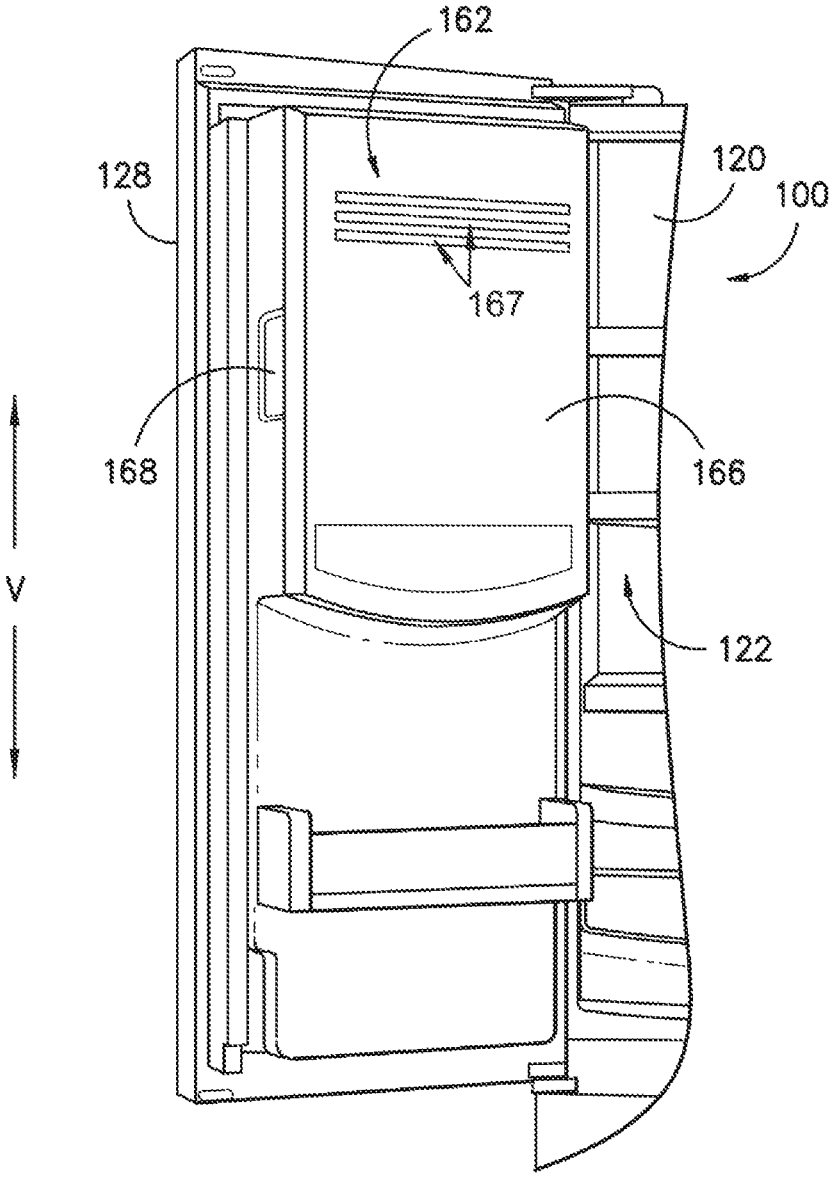
FIG. 2 provides a perspective view of a door of axe exemplary refrigerator appliance of FIG. 1.
Figure 3:
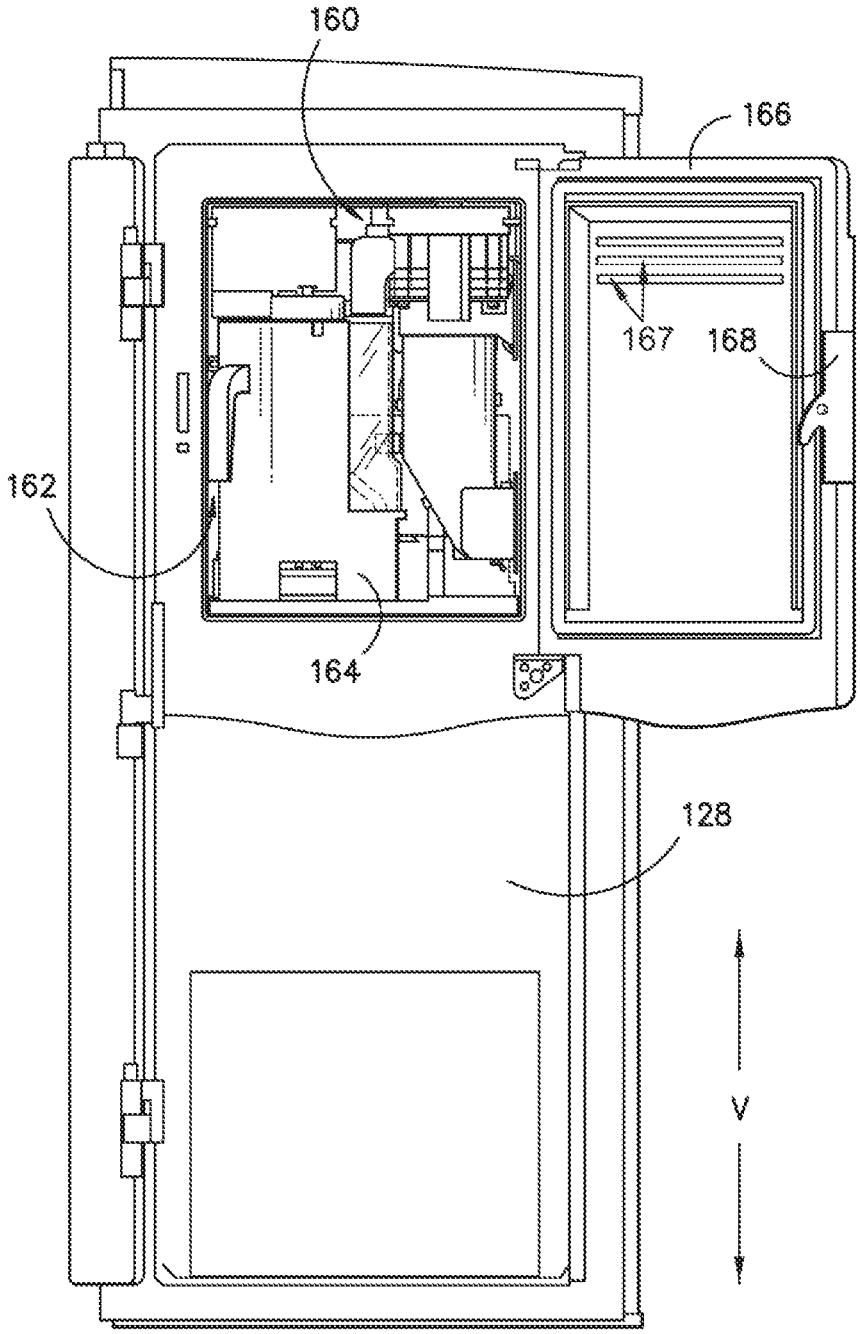
FIG. 3 provides an elevation view of the door of the exemplary refrigerator appliance of FIG. 2 with an access door of the door shown in an open position.

FIG. 2 provides a perspective view of a door of refrigerator doors 128. FIG. 3 provides an elevation view of refrigerator door 128 with an access door 166 shown in an open position. Refrigerator appliance 100 includes a freezer sub-compartment 162 defined on refrigerator door 128. Freezer sub-compartment 162 is often referred to as an "icebox." Freezer sub-compartment 162 extends into fresh food chamber 122 when refrigerator door 128 is in the closed position.

As may be seen in FIG. 3, an ice maker or ice making assembly 160 and an ice storage bin 164 are positioned or disposed within freezer sub-compartment 162. Thus, ice is supplied to dispenser recess 150 (FIG. 1) from the ice making assembly 160 and/or ice storage bin 164 in freezer sub-compartment 162 on a back side of refrigerator door 128. Chilled air from a sealed system (not shown) of refrigerator appliance 100 may be directing into ice making assembly 160 in order to cool ice making assembly 160. During operation of ice making assembly 160, chilled air from the sealed system cools components of ice making assembly 160, such as a casing or mold body of ice making assembly 160, to or below a freezing temperature of liquid water. Thus, ice making assembly 160 is an air cooled ice making assembly. Chilled air from the sealed system also cools ice storage bin 164. In particular, air around ice storage bin 164 can be chilled to a temperature above the freezing temperature of liquid water, e.g., to about the temperature of fresh food chamber 122, such that ice nuggets in ice storage bin 164 melt over time due to being exposed to air having a temperature above the freezing temperature of liquid water. In particular, slots 167 in access door 166 can permit air from fresh food chamber 122 into freezer sub-compartment 162 such that ice storage bin 164 is exposed to air from fresh food chamber 122.

Liquid water generated during melting of ice nuggets in ice storage bin 164, is directed out of ice storage bin 164. In particular, turning back to FIG. 1, liquid water from melted ice nuggets is directed to an evaporation pan 172. Evaporation pan 172 is positioned within a mechanical compartment 170 defined by housing 120, e.g., at bottom portion 102 of housing 120. A condenser 174 of the sealed system can be positioned, e.g., directly, above and adjacent evaporation pan 172. Heat from condenser 174 can assist with evaporation of liquid water in evaporation pan 172. A fan 176 configured for cooling condenser 174 can also direct a flow air across or into evaporation pan 172. Thus, fan 176 can be positioned above and adjacent evaporation pan 172. Evaporation pan 172 is sized and shaped for facilitating evaporation of liquid water therein. For example, evaporation pan 172 may be open topped and extend across about a width and/or a depth of housing 120.

Access door 166 is hinged to refrigerator door 128. Access door 166 permits selective access to freezer sub-compartment 162. Any manner of suitable latch 168 is configured with freezer sub-compartment 162 to maintain access door 166 in a closed position. As an example, latch 168 may be actuated by a consumer in order to open access door 166 for providing access into freezer sub-compartment 162. Access door 166 can also assist with insulating freezer sub-compartment 162.

Figure 4:
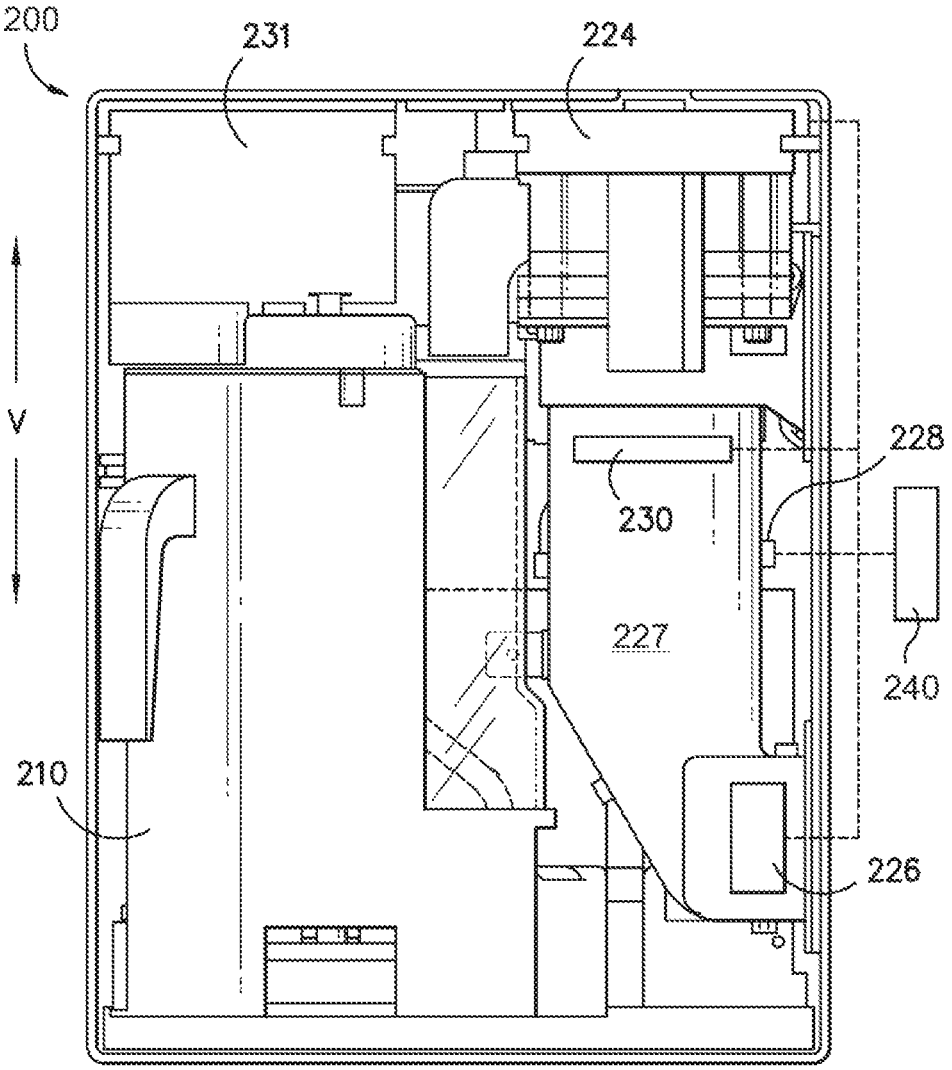
FIG. 4 provides an elevation view of an ice making assembly according to an exemplary embodiment of the present subject matter.
Figure 5:
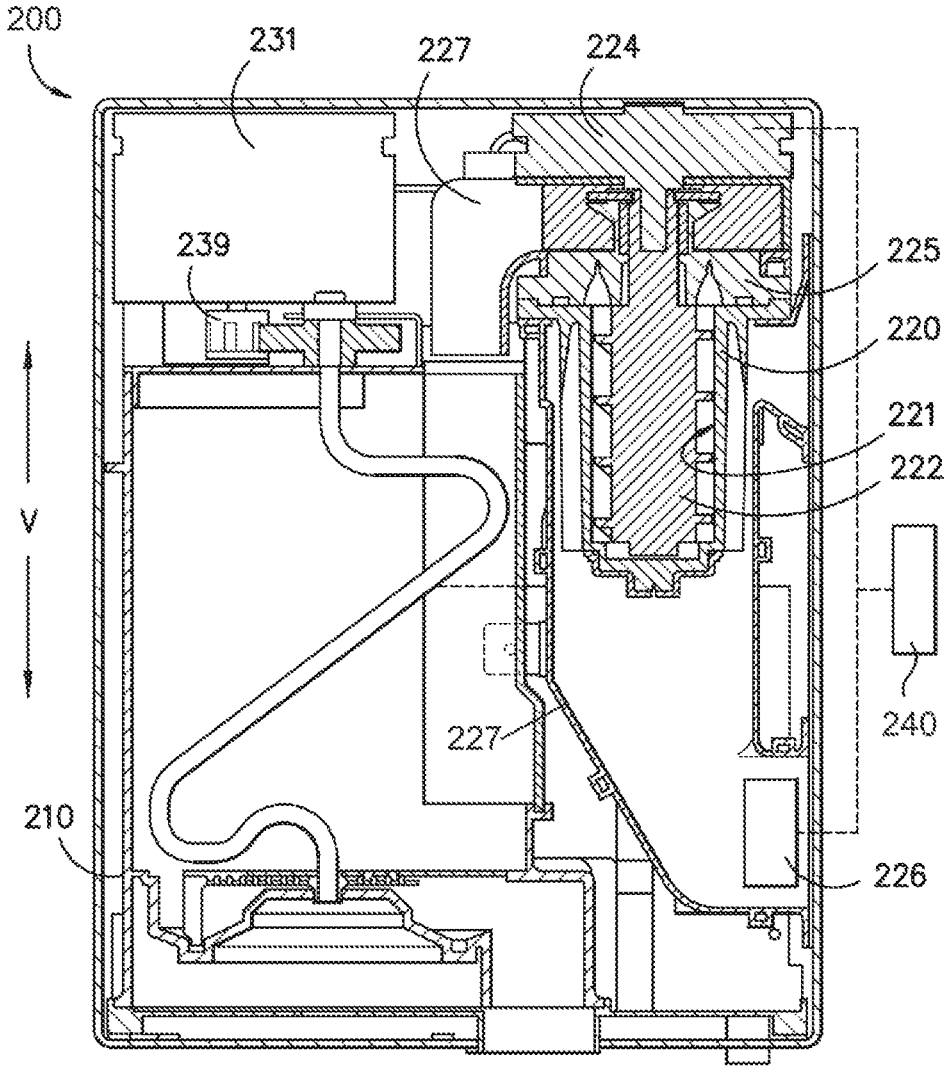
FIG. 5 provides a section view of the exemplary ice making assembly of FIG. 3.

FIG. 4 provides an elevation view of an ice making assembly 200 according to an exemplary embodiment of the present subject matter. FIG. 5 provides a section view of ice making assembly 200. Ice making assembly 200 can be used in any suitable refrigerator appliance. For example, ice making assembly 200 may be used in refrigerator appliance 100 as ice making assembly 160 (FIG. 3).

Ice making assembly 200 includes a mold body or casing 220. An ice making auger 222 (FIG. 3) is rotatably mounted within casing 220. In particular, an ice making motor 224 is mounted to casing 220 and is in mechanical communication with (e.g., coupled to) ice making auger 222. Ice making motor 224 is configured for selectively rotating ice making auger 222 within casing 220. During rotation of ice making auger 222 within casing 220, ice making auger 222 scrapes or removes ice off an inner surface 221 of casing 220 and directs such ice to an extruder 225. At extruder 225, ice nuggets are formed from ice within casing 220. An ice storage bin or ice bucket 210 is positioned below extruder 225 and receives the ice nuggets from extruder 225 via an ice nugget conduit 227. From ice bucket 210, the ice nuggets can enter dispensing assembly 140 (FIG. 1) and be accessed by a user as discussed above. In such a manner, ice making assembly 200 can produce or generate ice nuggets.

Ice making assembly 200 also includes a fan 226. Fan 226 is configured for directing a flow of chilled air through a housing or duct 227 towards casing 220. As an example, fan 226 can direct chilled air from an evaporator of a sealed system through duct 227 to casing 220. Thus, casing 220 can be cooled with chilled air from fan 226 such that ice making assembly 200 is air cooled in order to form ice therein. In particular, casing 220 may be indirectly cooled with air from freezer chamber 124 during operation of fan 226. Ice making assembly 200 also includes a heater 230 (FIG. 4), such as an electric resistance heating element, mounted to casing 220. Heater 230 is configured for selectively heating casing 220, e.g., when ice prevents or hinders rotation of ice making auger 222 within casing 220. Fan 226 can be a variable speed fan—meaning the speed of fan 226 may be controlled or set anywhere between and including, e.g., zero (0) and one hundred (100) percent.

Operation of ice making assembly 200 is controlled by a processing device or controller 240, e.g., that may be operatively coupled to control panel 148 for user manipulation to select features and operations of ice making assembly 200. Controller 240 can operates various components of ice making assembly 200 to execute selected system cycles and features. For example, controller 240 is in operative communication with ice making motor 224, fan 226 and heater 230. Thus, controller 240 can selectively activate and operate ice making motor 224, fan 226 and heater 230.

Controller 240 may include a memory and microprocessor, such as a general or special purpose microprocessor operable to execute programming instructions or micro-control code associated with operation of ice making assembly 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 240 may be constructed without using a microprocessor, e.g., using a combination of discrete analog and/or digital logic circuitry (such as switches, amplifiers, integrators, comparators, flip-flops. AND gates, and the like) to perform control functionality instead of relying upon software. Ice making motor 224, fan 226 and heater 230 may be in communication with controller 240 via one or more signal lines or shared communication busses.

Ice making assembly 200 also includes a temperature sensor 228 (FIG. 4). Temperature sensor 228 is configured for measuring a temperature of casing 220 and/or liquids, such as liquid water, within casing 220. Temperature sensor 228 can be any suitable device for measuring the temperature of casing 220 and/or liquids therein. For example, temperature sensor 228 may be a thermistor or a thermocouple. Controller 240 can receive a signal, such as a voltage or a current, from temperature sensor 240 that corresponds to the temperature of the temperature of casing 220 and/or liquids therein. In such a manner, the temperature of casing 220 and/or liquids therein can be monitored and/or recorded with controller 240.

Figure 6:
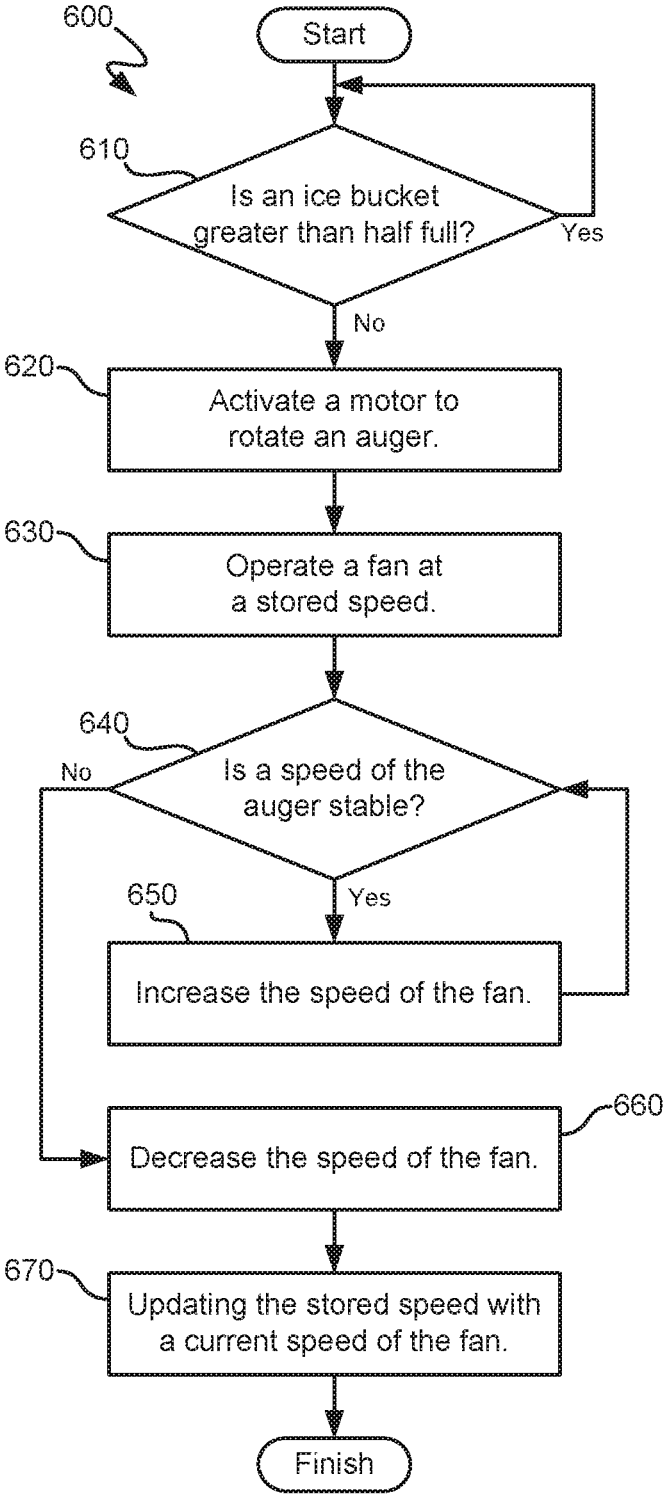
FIG. 6 illustrates a method for operating a fan of a nugget ice maker according to an exemplary embodiment of the present subject matter.

FIG. 6 illustrates a method 600 for operating a fan of a nugget ice maker according to an exemplary embodiment of the present subject matter. Method 600 may be used to operate a fan in any suitable nugget ice maker, such as a nugget ice maker within a refrigerator appliance or a stand-alone nugget ice maker. As an example, method 600 may be used with refrigerator appliance 100 to operate ice making assembly 200, and controller 240 of refrigerator appliance 100 may be programmed or configured to implement method 600. Thus, method 600 is discussed in greater detail below in the context of ice making assembly 200. Method 600 may assist with extending a working life of ice making motor 224, e.g., by avoiding applying excessive torque to ice making motor 224, as discussed in greater detail below.

At step 610, controller 240 determines whether ice bucket 210 is greater than half full. As an example, controller 240 may receive a signal from a sensor at ice bucket 210 in order to determine whether ice bucket 210 is greater than half full at step 610. The sensor at ice bucket 210 may be a rake, optical sensor, etc. If ice bucket 210 is greater than half full at step 610, method 600 loops back to step 610 and continues to monitor the level of ice in ice bucket 210. Conversely, method 600 may continue to step 620 if ice bucket 210 is not greater than half full at step 610. Thus, step 610 may assist with ensuring that ice bucket 210 has sufficient empty volume for receiving ice during subsequent steps of method 600. It should be understood that step 610 is optional and need not be included in certain exemplary embodiments of the present subject matter. In addition, any other suitable level of ice within ice bucket 210 may utilized at step 610. For example, controller 240 may determine whether ice bucket 210 is greater than a quarter full, three-quarters full, etc., in alternative exemplary embodiments.

At step 620, controller 240 activates ice making motor 224 in order to rotate ice making auger 222 within casing 220. In addition, controller 240 runs or turns on fan 226 in order to cool casing 220 with chilled air at step 630. Thus, at steps 620 and 630, controller 240 may operate ice making motor 224 and fan 226 in order to generate ice with ice making assembly 200. At step 630, controller 240 may operate fan 226 at a stored speed or first speed. The stored speed may be any suitable speed. For example, the stored speed may be a default value or a value saved from a previous iteration of method 600. In particular, the stored speed may be about fifty-percent of a maximum speed of fan 226 in certain exemplary embodiments. As used herein, the term "about" means within ten percent of the stated speed when used in the context of speeds. Thus, fan 226 may operate well below the maximum speed of fan 226 at step 630. A speed of fan 226 may be measured or monitored at step 620, e.g., with a Hall effect sensor in fan 226 or any other suitable method or mechanism. As another example, controller 240 may supply a particular voltage to fan 226 in order to operate fan 226 at the stored speed, e.g., without measurement feedback to ensure that fan 226 is operating at the stored speed.

Controller 240 may monitor a speed of ice making auger 222 within casing 220, e.g., while ice making motor 224 and fan 226 are operating. Thus, while fan 226 is operating at the stored speed, controller 240 may monitor the speed of ice making auger 222 within casing 220, e.g., with a Hall effect sensor proximate ice making auger 222 or any other suitable method or mechanism. The speed of ice making auger 222 within casing 220 may be inversely proportional to a torque on ice making motor 224, e.g., due to ice making auger 222 scrapping ice from inner surface 221 of casing 220. Thus, when ice making motor 224 is supplied with a constant power, the torque on ice making motor 224 increases as the speed of ice making auger 222 within casing 220 decreases. By monitoring the speed of ice making auger 222 within casing 220, the torque on ice making motor 224 may also be monitored.

At step 640, controller 240 determines whether the speed of ice making auger 222, e.g., while ice making motor 224 and fan 226 are operating, is stable. When fan 226 is operating at the stored speed, cooling of casing 220 with chilled air from fan 226 may increase an ice formation rate on inner surface 221 of casing 220 and in turn the torque on ice making motor 224. Thus, when the speed of ice making auger 222 is stable or substantially constant, the torque on ice making motor 224 may also be stable or constant. As used herein, the term "stable" means that the speed (or a moving average of the speed) of ice making auger 222 settles at or approaches a magnitude greater than a predetermined speed and does not decrease to a magnitude less than the predetermined speed over a period of time. Thus, when controller 240 determines that the speed of ice making auger 222 is, e.g., consistently, greater than the predetermined speed over the period of time, controller 240 may determine that the speed of ice making auger 222 is stable. The predetermined speed may correspond to the speed of ice making auger 222 when ice making motor 224 is operating at a maximum torque, e.g., a maximum desired torque for ice making motor 224.

When the speed of ice making auger 222 is stable, controller 240 increases a speed of fan 226, e.g., by a predetermined speed increment (e.g., about five percent of the maximum speed of fan 226, ten percent of the maximum speed of fan 226, etc.). By increasing the speed of fan 226 at step 250, cooling of casing 220 with chilled air from fan 226 may increase as well as the ice formation rate on inner surface 221 of casing 220. Thus, ice making assembly 200 may produce more ice by increasing the speed of fan 226 at step 250. However, as discussed above, the torque on ice making motor 224 also increases as the ice formation rate on inner surface 221 of casing 220 increases. Thus, method 600 loops back to step 640 after increasing the speed of fan 226 at step 650. Method 600 may continue to loop between step 640 and step 650 until the speed of ice making auger 222 is not stable at step 640.

When the speed of ice making auger 222 is not stable, controller 240 decreases the speed of fan 226, e.g., by the predetermined speed increment. Thus, method 600 may increase the speed of fan 226 by the predetermined speed increment until the speed of ice making auger 222 is not stable at step 640. The speed of fan 226 may then be decreased by the predetermined speed increment, e.g., such that fan 226 operates at a maximum speed that does not result in ice making motor 224 exceeding the maximum torque of ice making motor 224. At step 670, the current speed of fan 226 at step 660 may be saved in controller 240, e.g., such that the stored speed for fan 226 is replaced or updated with the current speed of fan 226 at step 660. In such a manner, method 600 may assist with determining the maximum speed of fan 226 that does not result in ice making motor 224 exceeding the maximum torque of ice making motor 224, and the maximum speed of fan 226 may be saved for used during subsequent ice making operations of ice making assembly 200.

Method 600 may assist with finding the maximum speed of fan 226 in various refrigerators or ice makers, e.g., despite variation in foaming, fan performance, sealed system performance, etc. Method 600 may be repeated for each ice making operation of ice making assembly 200. As another example, method 600 may be performed periodically, e.g., weekly, monthly, bimonthly, etc. In such a manner, method 600 may assist with adjusting the speed of fan 226 to account for changes in insulation, fan performance, sealed system performance, etc. over time.

Method 600 may also include deactivating fan 226 if the speed of ice making auger 222 drops below the predetermined speed. As discussed above, the predetermined speed may correspond to the speed of ice making auger 222 when ice making motor 224 is operating at a maximum torque. By deactivating fan 226 when the speed of ice making auger 222 drops below the predetermined speed, cooling of casing 220 with chilled air from fan 226 may decrease as well as the ice formation rate on inner surface 221 of casing 220. In such a manner, method 600 may avoid operating ice making motor 224 above the maximum torque of ice making motor 224.

Figure 7:
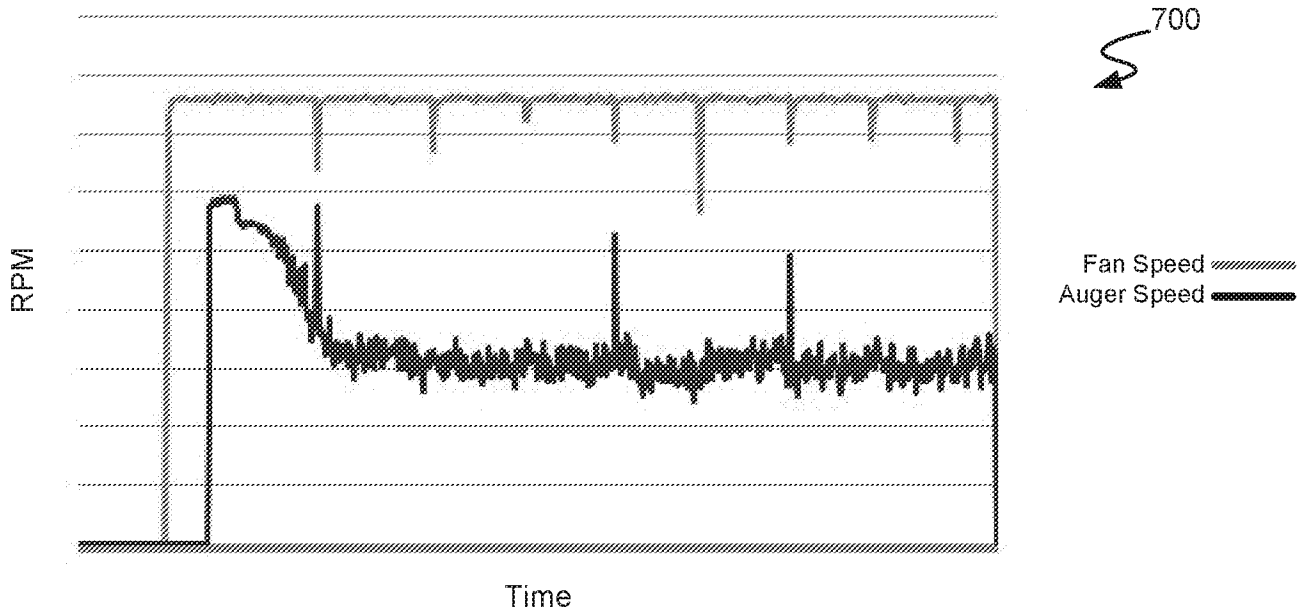
FIG. 7 provides a plot of auger speed and fan speed versus time during the exemplary method of FIG. 6.

FIG. 7 provides a plot 700 of auger speed and fan speed versus time during method 600. In particular, operation ice making assembly 200 after step 670 of method 600 is shown in FIG. 7. As may be seen in FIG. 7, the speed of ice making auger 222 is not continually falling; rather, the speed of ice making auger 222 settles over time. Thus, fan 226 need not cycle on/off to avoid operating ice making motor 224 above the maximum torque of ice making motor 224. Instead, fan 226 operates at an appropriate speed to cool casing 220 with chilled air from fan 226 and also providing a suitable ice formation rate on inner surface 221 of casing 220. In such a manner, a life expectancy of ice making motor 224 may be improved.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a fan of a nugget ice maker, comprising:

running the fan at a stored speed;

activating a motor of the nugget ice maker such that the motor of the nugget ice maker rotates an auger of the nugget ice maker;

monitoring a speed of the auger while the motor of the nugget ice maker rotates the auger of the nugget ice maker and the fan runs at the stored speed; and increasing a speed of the fan in response to the speed of the auger stabilizing during said step of monitoring.

2. The method of claim 1, further comprising deactivating the fan if the speed of the auger drops below a threshold speed during said step of monitoring.

3. The method of claim 2, wherein said step of increasing the speed of the fan comprises increasing the speed of the fan when the speed of the auger stabilizes during said step of monitoring and when the speed of the auger does not drop below the threshold speed during said step of monitoring.

4. The method of claim 1, wherein said step of increasing the speed of the fan comprises increasing the speed of the fan by a predetermined speed when the speed of the auger stabilizes during said step of monitoring.

5. The method of claim 4, further comprising repeating said step of monitoring and said step of increasing the speed of the fan until the speed of the auger does not stabilize during said step of monitoring.

6. The method of claim 5, further comprising reducing the speed of the fan by the predetermined speed after the speed of the auger does not stabilize during said step of monitoring.

7. The method of claim 6, further comprising updating the stored speed with the speed of the fan after said step of reducing.

8. The method of claim 1, wherein an ice bucket of the nugget ice maker is no greater than half full at said step of monitoring the speed of the auger while the motor of the nugget ice maker rotates the auger of the nugget ice maker and the fan runs at the stored speed.

9. The method of claim 1, wherein said step of increasing the speed of the fan comprises increasing the speed of the fan when the speed of the auger stabilizes above a threshold speed of the auger during said step of monitoring.

10. The method of claim 1, wherein the fan is configured for drawing chilled air generated by a sealed system to the nugget ice maker.

11. A method for operating a fan of a nugget ice maker, comprising:

operating the fan at a first speed;

activating a motor of the nugget ice maker such that the motor of the nugget ice maker rotates an auger of the nugget ice maker;

monitoring a speed of the auger while the motor of the nugget ice maker rotates the auger of the nugget ice maker; and operating the fan at a second speed in response to the speed of the auger being substantially constant for a predetermined period of time during said step of monitoring, the second speed being greater than the first speed.

12. The method of claim 11, further comprising deactivating the fan if the speed of the auger drops below a threshold speed during said step of monitoring.

13. The method of claim 12, wherein said step of operating the fan at the second speed comprises operating the fan at the second speed when the speed of the auger is substantially constant during said step of monitoring and when the speed of the auger does not drop below the threshold speed during said step of monitoring.

14. The method of claim 11, further comprising repeating said step of monitoring while the fan operates at the second speed; and operating the fan at a third speed when the speed of the auger is substantially constant for the predetermined period of time during said step of monitoring while the fan operates at the second speed, the third speed being greater than the second speed.

15. The method of claim 14, further comprising:

repeating said step of monitoring while the fan operates at the third speed; and reducing the speed of the fan to the second speed when the speed of the auger is not substantially constant for the predetermined period of time during said step of monitoring while the fan operates at the third speed.

16. The method of claim 15, further comprising saving the second speed in a memory of the nugget ice maker such that the first speed is updated to the second speed.

17. The method of claim 11, wherein an ice bucket of the nugget ice maker is no greater than half full at said step of monitoring the speed of the auger while the motor of the nugget ice maker rotates the auger of the nugget ice maker and the fan runs at the stored speed.

18. The method of claim 11, wherein said step of operating the fan at the second speed comprises operating the fan at a second speed when the speed of the auger is substantially constant above a threshold speed of the auger for a predetermined period of time during said step of monitoring.

19. The method of claim 11, wherein the fan is configured for drawing chilled air generated by a sealed system to the nugget ice maker.

* * * * *